US006025926A

United States Patent [19]

Smith et al.

[11] Patent Number: 6,025,926

[45] Date of Patent: Feb. 15, 2000

[54] POST-PRINTER OPEN ARCHITECTURE DEVICE

[75] Inventors: Wayne R. Smith, Pittsford; Clifford L. George, Geneseo; Donald R. Ryan, Webster, all of N.Y.

[73] Assignee: Xerox Corporation, Stamford, Conn.

[21] Appl. No.: 09/005,349

[22] Filed: Jan. 9, 1998

[51] Int. Cl.[7] ..... G06A 15/00

[52] U.S. Cl. ..... 358/1.18; 358/1.12

[58] Field of Search ..... 395/101, 106, 395/111, 112; 347/138, 152, 170, 222, 242, 245, 263; 346/145, 146

[56] References Cited

U.S. PATENT DOCUMENTS 5,053,977 10/1991 Baur et al. .
5,083,157 1/1992 Smith et al. .

*Primary Examiner*—Arthur G. Evans
*Attorney, Agent, or Firm*—Fay, Sharpe, Fagan, Minnich & McKee LLP

[57] ABSTRACT

A post-printer open-architecture device includes a document input region for receiving documents from a document printing apparatus and a document output region for outputting post-processed documents. An open-architecture document post-processing region is located intermediate the document input and output regions and includes a transport surface for conveying documents from the document input region to the document output region. A module mounting assembly releasably receives and secures at least one document post-processing module in an operative position to perform one or more post-processing operations on a document conveyed on the transport surface. Suitable post-processing modules to be connected to the module mounting assembly include ink-jet printing modules, color application modules, magnetic ink character recognition conversion modules, magnetic ink character recognition verification modules, bar-code reader modules, brail embossing modules, perforation modules, slitting modules, foil application modules, envelope stuffing modules, and postage metering modules.

11 Claims, 4 Drawing Sheets

POST-PRINTER OPEN ARCHITECTURE DEVICE

BACKGROUND OF THE INVENTION

The present invention relates generally to electrophotographic and other document printing devices, and more particularly to an open architecture device usable downstream from an electrophotographic or other printing or document reproduction apparatus for performing various post-processing operations on the documents output from the printing apparatus.

Electrophotographic printing and reproduction devices are well known. Typically, a photoconductive member is charged to a uniform potential and thereafter exposed to a light image of an original document to be reproduced. The exposure discharges the photoconductive member in areas corresponding to the background of the document being reproduced and creates a latent image on the photoconductive member. Alternatively, in a laser-beam printer or the like, a light beam is modulated and used to selectively discharge portions of the photoconductive member in accordance with image information. With either type of apparatus, the latent image on the photoconductive member is visualized by developing the image with a developer powder commonly referred to as "toner." Most systems employ developer which comprises both charged carrier particles and charged toner particles which triboelectrically adhere to the carrier particles. During development of the latent image, the toner particles are attracted from the carrier particles by the charged pattern of image areas on the surface of the photoconductive member to form a visualized toner image on the photoconductive member. This toner image is then transferred to a recording medium such as paper or the like for viewing by an end user. Typically, the toner is fixed to the surface of the paper through the application of heat and pressure.

Following the successful reproduction of one or more documents in this fashion, it is often desirable to perform one or more of a wide variety of post-processing functions on the printed documents. For example, certain applications require the selective addition of color or other enhancements to the printed documents using ink jet annotation or the like, application of magnetic ink character recognition media, job/document serial number and account auditing, insertion of pages into the printed documents, brail embossing, perforation, slitting, envelope stuffing, and postage metering. Heretofore, the post-processing functions could be carried out off-line with one or more dedicated post-processing devices. Of course, the off-line devices were specially designed to perform certain specific post-processing functions. The performance of other post-processing functions necessitated the replacement of some or all of these off-line devices in their entirety, including all of the base document handling and other hardware thereof. Other post-processing devices are designed to work on-line with a electrophotographic printing apparatus. Like the off-line devices, these on-line devices have been limited to specific functions, and must also be completely replaced in the event an end-user desires to perform different post-processing operations.

Accordingly, a need has been recognized for a post-printer open-architecture device capable of performing any of a wide variety of post-processing functions using the same base document handling hardware, but also releasably receiving one or more post-processing modules that perform particular post-processing functions. The subject invention is deemed to meet the foregoing needs and others, and to provide an open-architecture post-processing device that demonstrates better and more advantageous overall results.

SUMMARY OF THE INVENTION

In accordance with a first aspect of the present invention, a post-printer open-architecture device includes a document input region for receiving documents from a document printing device and a document output region for outputting post-processed documents. An open-architecture document post-processing region is located intermediate the document input and output regions and includes a transport surface for conveying documents from the document input region to the document output region. A module mounting assembly releasably receives and secures at least one document post-processing module in an operative position to perform a post-processing operation on a document conveyed on the transport surface.

In accordance with another aspect of the present invention, a document printing apparatus includes a printed document output and a post-printer open-architecture device. The post-printer open-architecture device itself includes a document input interface connected to the printed document output to receive printed documents therefrom and a document output for outputting post-processed documents. Further, the post-printer device includes an open-architecture post-processing region having a transport surface for transporting documents from the document input interface to the post-processed document output. A document post-processing module mounting assembly releasably receives and secures at least one document post-processing module in an operative position relative to documents transported on the transport surface.

One advantage of the present invention is that it allows for a wide variety of document post-processing operations to be performed without modification of base document handling hardware of the post-printer device.

Another advantage of the present invention is found in the provision of a post-printer open-architecture device that allows a plurality of different document post-processing modules to be connected thereto.

Still another advantage of the present invention is that it is usable on-line with an electrophotographic or other printing apparatus, or off-line as a stand-alone device.

A further advantage of the present invention resides in the provision of a post-printer open-architecture magnetic ink character recognition converting device with variable configurations of magnetic ink character recognition converting modules as needed for particular applications.

A still further advantage of the present invention is the provision of an open-architecture device that includes base document handling hardware and that is adapted to receive one or more document post-processing modules, as needed, in a quick and easy manner to perform different post-processing functions using the same base document handling hardware.

Still other benefits and advantages of the present invention will become readily apparent to those skilled in the art upon reading and understanding the following detailed specification.

BRIEF DESCRIPTION OF THE DRAWINGS

The invention may take physical form in certain components and arrangements thereof, preferred embodiments of which are described in detail in the specification and illustrated in the accompanying drawings which form a part hereof and wherein.

DETAILED DESCRIPTION OF THE PREFERRED EMBODIMENTS

Figure 1:
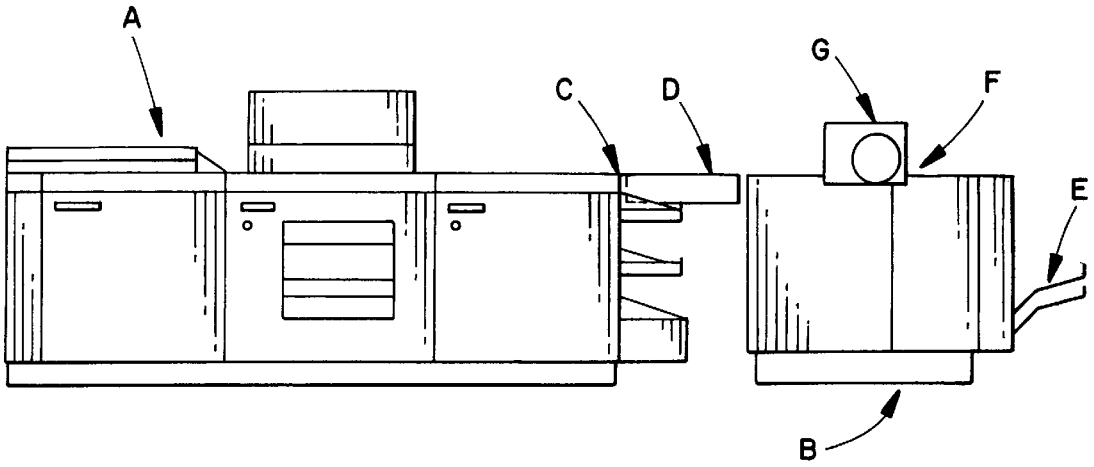
FIG. 1 is a front elevational view of an electrophotographic printing apparatus including an on-line post-printer open-architecture device in accordance with the present invention.

Referring now to the drawings wherein the showings are for purposes of illustrating preferred embodiments of the invention and not for purposes of limiting the same, FIG. 1 illustrates a document printing apparatus A and a post-printer open-architecture device B in accordance with the present invention connected to the printing apparatus in an on-line relationship therewith. Those skilled in the art will recognize that the printing device A may be an electrophotographic printing device or any other suitable printing or document reproduction device such as an ink-jet printer or the like. The printing device A includes a document output region or assembly C which outputs original printed documents or reproductions of printed documents. The subject post-printer open-architecture device B includes an input interface D which receives documents from the output region C of the printing device for input to the post-printer open-architecture device B. The post-printer device B also includes a document output region E for providing finished or partially finished documents to an end-user, or for interfacing with another on-line document post-printer device B or other device using a suitable mechanical and control system interface as described below in relation to the input interface D. Other post-processing devices connectable to the output interface E include folding, slitting, envelope stuffing, postage metering, and other such devices.

Figure 2:
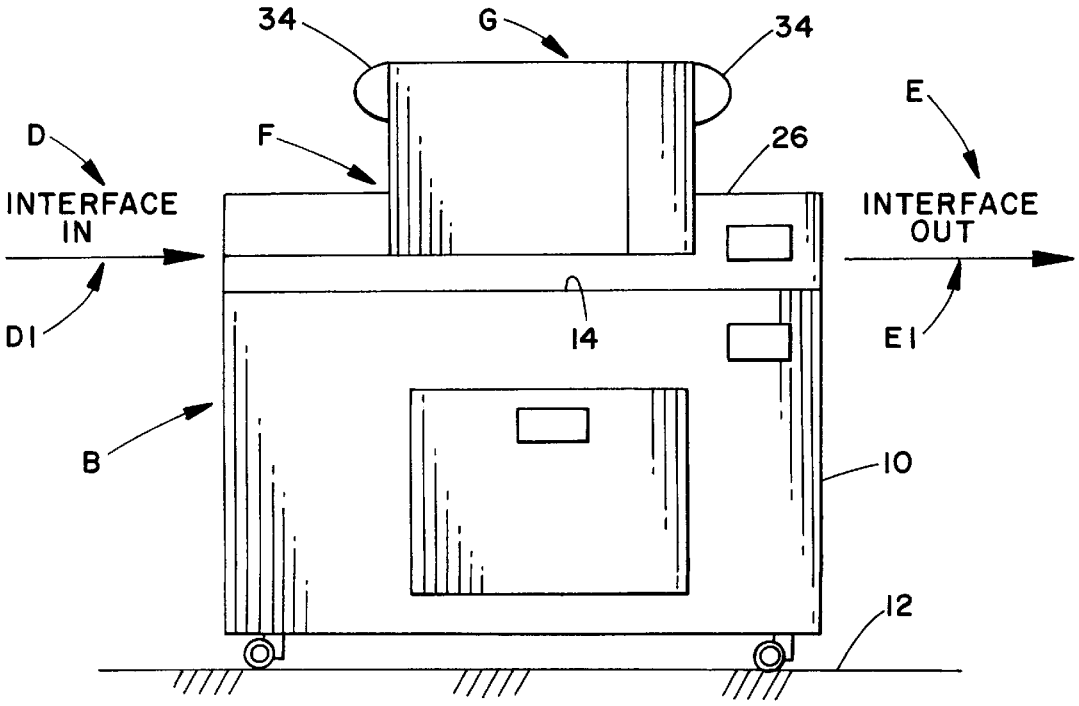
FIG. 2 is a front elevational view of the on-line post-printer open-architecture device shown in FIG. 1.
Figure 3:
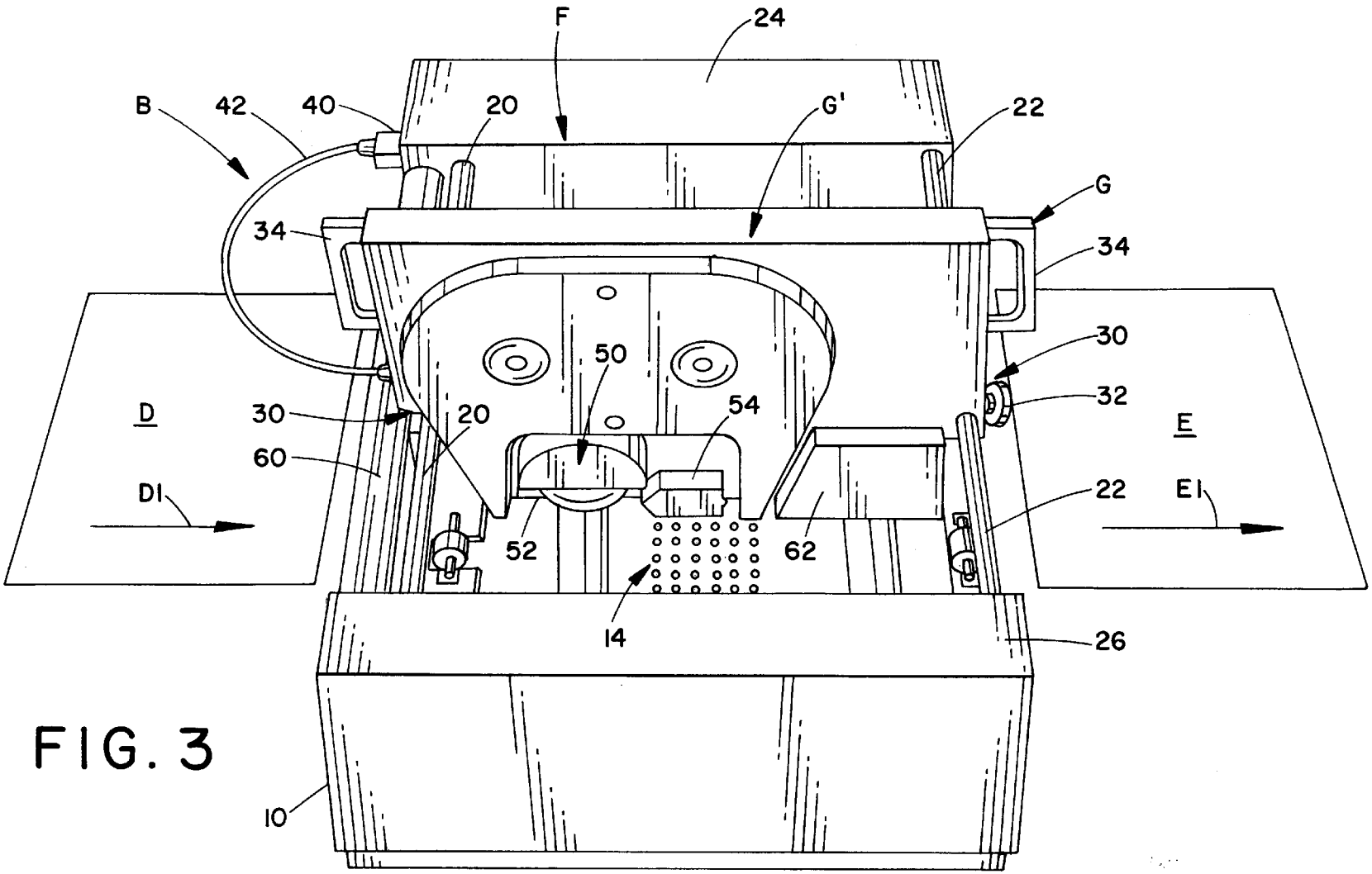
FIG. 3 is a perspective view of an open-architecture document post-processing region of the on-line post-printer open-architecture device of FIG. 1.

With reference now also to FIGS. 2 and 3, the on-line post-printer open-architecture device B includes a frame or chassis 10 for supporting the device above a support surface 12 such as a shop floor or the like. The input interface D comprises a mechanical interface such as a vacuum sheet transport surface, roller transport assembly, or the like for paper transport in the direction of the arrow D1 from the printer A to the post-printer device B, as well as an electrical or opto-electrical interface for the transmission of control signals between printer A and post-printer device B. Suitable input interfaces D comprising the necessary mechanical and control signal interfaces include the Document Finishing Architecture (DFA) and Multi-Feeding Finishing Architecture (MFFA) interfaces developed by Xerox Corporation, Stamford, Conn., as well as any other suitable interface D that effectively transports documents from the output C of the printer A to the post-printer device B and the provides communication between the control systems of the printer A and post-printer device B.

The post-printer device B further includes an open-architecture document processing region F where one or more post-processing operations are performed on the documents received from the printer apparatus A by way of the input interface D. The open-architecture configuration of the region F allows one or more post-processing modules G to be releasably and operatively connected to the post-printer device B for performing various document post-processing functions as desired. For example, modules G may be provided to perform any desired document post-processing function including, but not limited to, ink-jet or other annotation with color or other ink, magnetic character ink conversion and signal level verification, job and/or document serial number/account auditing, bar code reading, insertion of sheets, brail embossing, perforation, slitting, scoring, application of foil, envelope stuffing, postage metering, and other such functions.

The document processing region F of the post-printer device B comprises a transport surface 14 that receives documents from the input interface D and conveys the documents relative to the one or more post-processing modules G to the post-printer device output interface or region E. Documents conveyed on the transport surface 14 are acted upon by the one or more modules G to effect the desired document post-processing. The transport surface 14 may be provided by a variety of structures, but generally will comprise a vacuum transport conveyor surface, one or more roller assemblies, or other suitable document transport surfaces. Further, the transport surface 14 is preferably of the edge registration type including one or more document guides to ensure that each document transported thereon is positioned at a known position on an axis transverse to the direction of document flow D1,E1. Those skilled in the art will recognize that other suitable transport surfaces exist and may be utilized within the scope and spirit of the invention.

To provide for the operative connection of one or more document post-processing modules G to the open-architecture document processing region F of the post-printer device B, the device B comprises a mechanical module mounting assembly which releasably receives and retains one or more post-processing modules G. As is best seen with reference to FIG. 3, the mechanical mounting assembly preferably comprises at least one mounting rail 20 extending transversely above the transport surface 14. Most preferably, the mounting assembly comprises at least first and second cylindrical mounting rails 20,22, each of which is connected at its opposite ends to vertically extending sidewalls 24,26, respectively, which extend upward from the chassis 10 on opposite lateral sides of the transport surface 14. A module G includes one or more clamps 30, such as C-clamps or the like positioned to slidably engage the rails 20,22 such that each module G is supported in an operative position above the transport surface 14 in the document processing region F of the post-printer device B.

Each clamp 30 preferably includes an adjustment knob 32 or other means for hand manipulation by an operator. After a module G is positioned on the rails 20,22 using the clamps 30, the lateral position of the module G along the transverse axis is manually adjusted by sliding the module G on the rails 20,22. Once positioned as desired, the operator tightens the clamps 30 using the knob 32 to prevent further movement of the module G along the transverse axis above the surface 14, and to prevent disengagement of the module from the rails 20,22. Those skilled in the art will recognize that a plurality of modules G are able to be selectively positioned on the rails 20,22, as desired and necessary, to perform their respective post-processing functions, while each is able to advantageously use the same document input interface D, transport surface 14, and document output interface E. To further facilitate module insertion, removal, and lateral position adjustment, each module G preferably includes one or more operator hand grasp handles 34.

In addition to a mechanical interface such as the mounting rails 20,22, the open-architecture document processing region F also includes a control system interface for optically, electrically, or otherwise connecting the one or more modules G to the control system of the post-printer device B and/or the printer A, itself. As shown herein, the document processing region F control system interface is provided by one or more electrical sockets 40 which receive and couple with module input/output control cable/plug assemblies 42. Those skilled in the art will recognize that other wired and wireless interfaces may be used without departing from the scope and intent of the invention.

Figure 4:
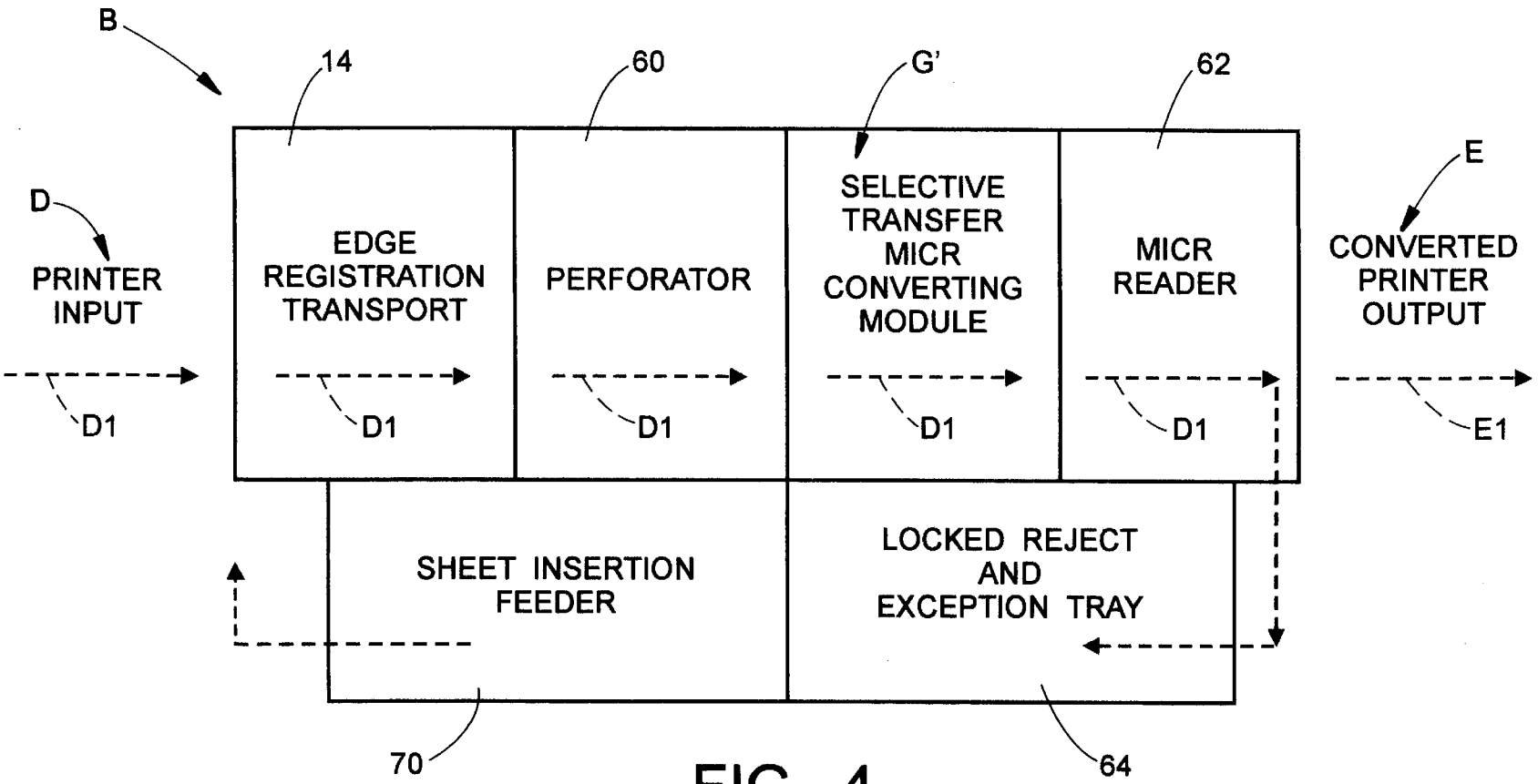
FIG. 4 diagrammatically illustrates the document flow paths and operations of the post-printer open-architecture device as configured for magnetic ink character recognition conversion operations.

FIGS. 3 and 4 illustrate the post-printer open-architecture device B as it is preferably configured as a post-printer magnetic ink character recognition converting device. As such, one or more magnetic ink character recognition converting modules G' are operatively connected to the rails 20,22. The module G' is the same in all respects as the module G described above, except that the module G' includes the necessary components to transfer magnetic media to select portions of a document passing from the input interface D to the output interface E on the transport surface 14. Both the construction and operation of the preferred magnetic ink character recognition converting device are described in full detail in commonly assigned U.S. Pat. No. 5,083,157, the disclosure of which is hereby expressly incorporated by reference herein.

Once the module G' is connected to the rails 20,22, it is positioned on the transverse axis such that a document passing thereunder on the transport surface 14 will be properly positioned to receive magnetic media over select portions thereof. Once so positioned, the knob 32 is turned to tighten the one or more clamps 30 to fix the lateral position of the module G'. Those skilled in the art will recognize that, if desired, a plurality of modules G', e.g., four modules, may be connected to the rails 20,22 for transferring magnetic media to a plurality of different regions of a document passing thereunder on the surface 14.

More particularly, the module G' applies magnetic media to the toner images on selected parts of a document positioned on the transport surface 14 and passing beneath the module G'. The toned image portions to which the magnetic media is transferred are thereafter able to be "read" by conventional magnetic ink character recognition devices such as a reader/sorter apparatus as is employed in the automated processing of bank checks.

The module G' comprises a conventional fuser 50 mounted against the back of a thin film 52. As described in the aforementioned U.S. Pat. No. 5,083,157, the film 52 comprises a heat-resistant substrate, e.g., polyester film, with a layer of magnetic media adhered to the front surface thereof. The module G' includes a supply of the film 52 in cassette or other form. The one or more modules G' are positioned such that those portions of a document on the transport surface 14 to which magnetic media is to be applied pass directly below the fuser 50. The fuser 50 thus heats and presses the film 52 against the relevant portion of the document. The heat causes the magnetic media that is directly over the standard toner images on the document to release from the film 52 and adhere only to the standard toner images. Portions of the subject document not beneath the fuser 50, or beneath the fuser 50 but not containing toner, do not receive any application of magnetic media. Preferably, a cooling device 54 cools the magnetic media and the underlying toner to prevent smearing or the like upon subsequent document handling.

The most preferred magnetic ink character recognition converting module G', as shown herein, includes a perforator 60 to selectively perforate portions of a document traveling on the transport surface 14 as is frequently required when printing bank checks or other negotiable instruments. The perforator is adjustable such that any select portion of a document on the surface 14 is able to be perforated. Also, to ensure that the magnetic media is actually and properly applied to the relevant portions of a document as described, the preferred module G' also comprises a magnetic ink character verification reader assembly 62. The verification reader 62 senses the presence of the magnetic media on a document and/or attempts to actually "read" the converted portions of the document. In the event that the module G' malfunctions or is not properly positioned, the reader will be unable to sense and/or read the magnetic media. In such case, the reader 62 will issue an error condition to the control system of the post-printer device B.

If desired, the reader 62 is also usable to control the flow of documents. As shown in FIG. 4, in the event the reader 62 identifies a document to which the magnetic media was not applied or to which the magnetic media was improperly applied, the post-printer device is able to divert the reject document into a locked reject bin 64 in the chassis 10 of the post-printer device B. A rejected check or other document is automatically logged in a memory device by the reader 62 so that it can be scheduled for reprint. Likewise, documents that are inadvertently duplicated or that are otherwise invalid can be automatically diverted into the reject bin 64 upon being detected by the reader 62. Also, if desired, the reader 62 is used to total or otherwise track the actual data imprinted on the documents transported therepast. Alternatively or additionally, the bin 64 is used to collect documents that are to be purposefully excepted from subsequent processing steps. Similarly, the post-printer device B also optionally includes a sheet insertion feeder 70 which inserts one or more document sheets into the flow of documents on the transport surface 14. Such is often desirable for the automated insertion of sheets such as high resolution offset press output, black and white glossy photographs, tab stock, covers and dividers, or other standard document sheets.

Figure 5:
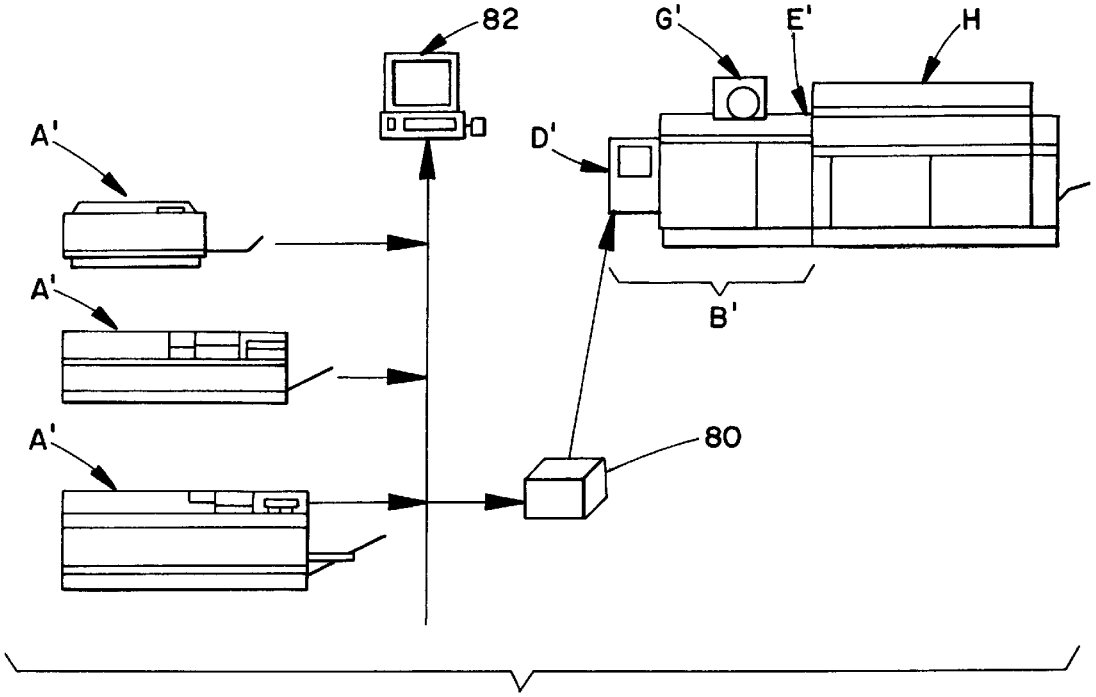
FIG. 5 diagrammatically illustrates an off-line post-printer open-architecture device in accordance with a second embodiment of the present invention; and, FIG. 6 illustrates a front elevational view of the off-line post-printer open architecture device of FIG. 5.
Figure 6:
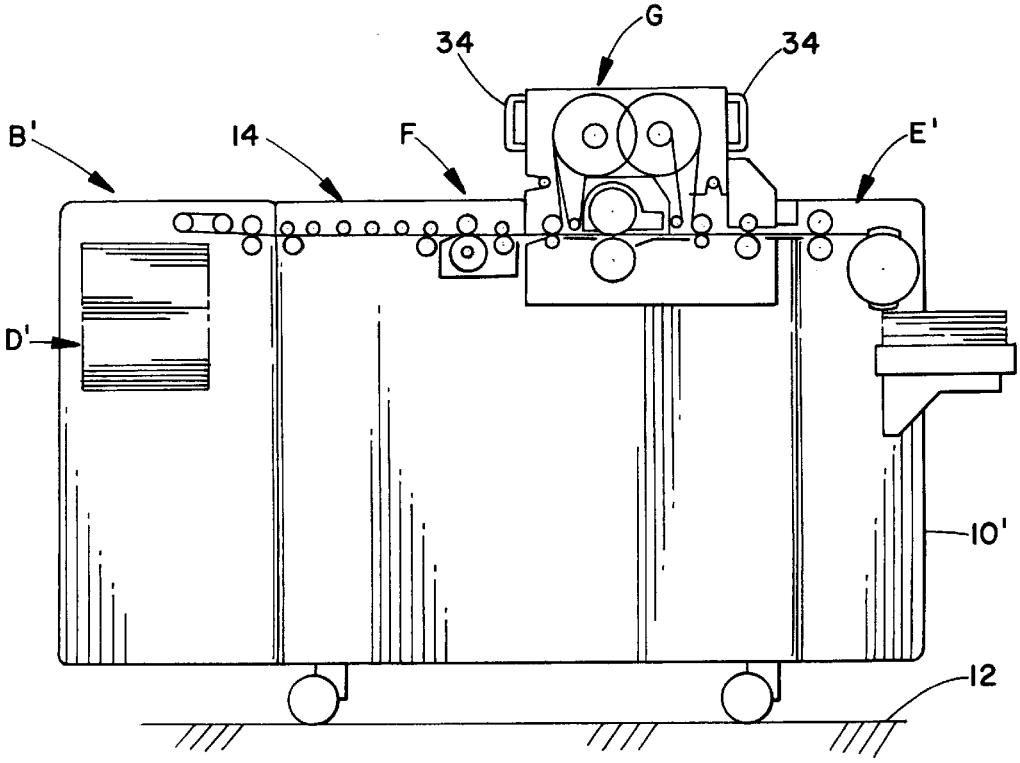

With reference now to FIGS. 5 and 6, an off-line post-printer open-architecture device B' in accordance with a second embodiment of the present invention is illustrated. For ease of reference, like components relative to the on-line post-printer open-architecture device B are illustrated with like reference numerals and letters including a primed (') suffix. New components are identified with new reference numerals and letters.

One or more document printing or reproduction devices A', which may include electrophotographic printing devices, ink-jet printing devices, and/or any other such devices provide output documents to a central document collection area 80. When the one or more printing devices A' have completed the printing operations or when sufficient documents are collected, the printing devices A' optionally provide a signal to an input/output programming device 82 such that an operator of the off-line post-printer device B' is notified and such that the input/output programming device 82 outputs a start signal to the off-line post-printer device B'. The documents collected in the central collection area 80 are supplied to a document input feeder assembly D' of the post-printer device B'. For example, as shown herein, the document input feeder assembly is provided by a vacuum feeder assembly with a capacity of, for example, 2500 sheets of paper.

The document input feeder assembly D' supplies the input sheets to the main transport surface 14, preferably an edge registration transport surface, for transport to the open-architecture document processing region F, which is the same as the document processing region described in relation to FIGS. 1–4, for post-processing by the one or more post-processing modules G secured in the document processing region. As is shown most clearly in FIG. 6, the document output region or assembly E' comprises a document sorter or stacker assembly such as, for example, a 2500 sheet disc stacker assembly. Alternatively, as shown in FIG. 5, the document output assembly E' is connected to a subsequent document processing devices 86 such as, for example, booklet makers, sealer gluer devices, and the like. The on-line and off-line post-processing devices B, B' are otherwise similar in all respects.

While particular embodiments of the present invention have been described, it should be apparent that changes and modifications may be made to such embodiments without departing from the true scope and spirit of the invention. It is intended that the appended claims cover all such changes and modifications.

Having thus described the preferred embodiments, the invention is now claimed to be:

1. A post-printer open-architecture device comprising:

a document input region for receiving printed documents from a document printing device;

a document output region for outputting post-processed documents;

an open-architecture document post-processing region intermediate said document input and output regions, said open-architecture document processing region including:

a transport surface for conveying documents from said document input region to said document output region in a transport direction, and, a module mounting assembly for releasably receiving and securing at least one document post-processing module in an operative position relative to said transport surface such that said at least one module is positioned to perform a post-processing operation on a document conveyed on said transport surface, said module mounting assembly comprising first and second parallel module attachment rails spaced above and spanning said transport surface transversely relative to said transport direction, each of said module attachment rails having opposite ends connected respectively to first and second sidewalls extending upward from a chassis on opposite sides of said transport surface; and, at least one document post-processing module releasably connected to said at least first and second module attachment rails and operatively positioned at a select lateral location above said transport surface to perform a document post-processing operation on a document positioned on said transport surface.

2. The post-printer open-architecture device as set forth in claim 1, wherein said at least one document post-processing module is at least one of an ink-jet printing module, a color application module, a magnetic character recognition ink conversion module, a magnetic ink character recognition verification module, a bar-code reader module, a brail embossing module, a perforation module, a slitting module, a foil application module, an envelope stuffing module, and a postage metering module.

3. The post-printer open-architecture device as set forth in claim 1, wherein said at least one document post-processing module is a magnetic ink character recognition conversion device including:

a supply of magnetic media conversion tape, said tape comprising a heat-resistant film substrate including magnetic media adhered to a first surface thereof, and, a heat fuser for heating said film and pressing said magnetic media onto select portions of a document being conveyed on said transport surface, whereby said magnetic media is transferred from said heat-resistant film to toned images on a said select portion of said document.

4. The post-printer open-architecture device as set forth in claim 3 wherein said magnetic ink character recognition conversion module further comprises a magnetic ink character recognition conversion verification reader assembly for verifying proper application of magnetic media to said toned images on said select portion of said document.

5. The post-printer open-architecture device as set forth in claim 1, wherein said at least one module is slidable transversely relative to said transport direction when connected to said first and second rails, said at least one module including a clamp assembly for releasably engaging at least one of said first and second module attachment rails to immovably fix the position of said at least one module above said transport surface.

6. The post-printer open-architecture device as set forth in claim 1, further comprising a plurality of post-processing modules connected to said at least first and second module attachment rails and operatively positioned in a laterally spaced relationship above said transport surface to perform at least one document post-processing operation on a document positioned on said transport surface.

7. The post-printer open-architecture device as set forth in claim 2 further comprising at least one of a reject bin for receiving documents diverted from said transport surface upstream relative to said document output region, and a sheet insertion feeder, positioned downstream relative to said document input region, for inserting document sheets onto said transport surface.

8. The post-printer open-architecture device as set forth in claim 1 wherein said transport surface is an edge registration transport surface for positioning each document supported thereon at a known lateral position relative to a document flow direction.

9. The post-printer open-architecture device as set forth in claim 1, further comprising a printing apparatus having a printed document output connected to said document input region of said post-printer device whereby printed documents output by said printer apparatus are fed on-line to said post-printer open-architecture device.

10. The post-printer open-architecture device as set forth in claim 1 further comprising a document post-processing apparatus connected with said document output region of said post-printer open-architecture device.

11. The post-printer open-architecture device as set forth in claim 9 wherein said printing apparatus is one of an electrophotographic document reproduction apparatus and a laser-beam printing apparatus.

* * * * *